United States Patent [19]

Zimmern

[11] Patent Number: 4,569,640

[45] Date of Patent: Feb. 11, 1986

[54] DEVICE FOR HIGH PRESSURE COMPRESSION

[76] Inventor: Bernard Zimmern, 27, rue Delabordère, 92200 Neuilly-sur-Seine, France

[21] Appl. No.: 491,679

[22] Filed: May 5, 1983

[30] Foreign Application Priority Data

May 13, 1982 [FR] France ..... 82 08323

[51] Int. Cl.[4] ..... F04B 17/00

[52] U.S. Cl. ..... 417/382; 417/406; 418/88; 418/99

[58] Field of Search ..... 417/323, 405, 406, 407, 417/382; 418/88, 97, 98, 99, DIG. 1

[56] References Cited

U.S. PATENT DOCUMENTS

| | | | |
|---|---|---|---|
| 1,134,215 | 4/1915 | Morse | 417/323 |
| 2,475,316 | 7/1949 | Garraway | 417/406 |
| 2,502,241 | 3/1950 | Yates | 417/406 |
| 3,073,514 | 1/1963 | Bailey et al. | 418/88 |
| 3,133,695 | 5/1964 | Zimmern . | |
| 3,180,565 | 4/1965 | Zimmern . | |
| 3,191,854 | 6/1965 | Lowler et al. | 418/88 |
| 3,710,590 | 1/1973 | Kocher | 418/88 |
| 3,752,606 | 8/1973 | Zimmern . | |
| 3,785,755 | 1/1974 | Novak et al. | 418/88 |
| 3,945,464 | 3/1976 | Sato . | |
| 4,035,114 | 7/1977 | Sato | 418/88 |
| 4,306,575 | 12/1981 | Minozzi, Jr. | 417/406 |

FOREIGN PATENT DOCUMENTS

| | | | |
|---|---|---|---|
| 2258545 | of 1975 | France . | |
| 62991 | 4/1982 | Japan | 418/88 |

*Primary Examiner*—Carlton R. Croyle
*Assistant Examiner*—Donald E. Stout
*Attorney, Agent, or Firm*—Ziems, Walter & Shannon

[57] ABSTRACT

A screw compressor discharges a fluid including a mixture of highly compressed gas and liquid into a separator reservoir, and a hydraulic motor is driven by at least a portion of the fluid. An injection conduit connects the bottom of the reservoir to a liquid injection port through the casing of the compressor. A pump driven by the hydraulic motor is mounted on the injection conduit. The motor-pump assembly is in a common casing. The injection port is in an area of the casing which is substantially subjected to high pressure.

8 Claims, 6 Drawing Figures

DEVICE FOR HIGH PRESSURE COMPRESSION

The present invention relates to a device for high pressure compression, especially but not limitatively one comprising a screw compressor.

French Pat. No. 2,098,655 discloses how to provide an injection of liquid into a gas compressor made of a screw meshing with at least one pinion-wheel. The injection point generally appears as being optimal when registering with threads subjected to the intake pressure or to the pressure at beginning of compression.

There thus exists a sufficient pressure differential with the discharge pressure to have the injection liquid circulate without need for an auxiliary pump, as shown for instance in the patent of addition 78,706 to French Pat. No. 1,268,586.

This solution does not apply, or applies badly, to the case where the screw compressor is used to produce high pressure, i.e. discharge pressures exceeding substantially 30 bar.

Indeed, to obtain such pressures, generally through multi-stage compression, the increase of the absolute pressure per stage of compression must be low enough to be compatible with the maximum permissible bend of components such as the pinions.

Thus, when considering compression stages at increasing pressures, the compression ratio of each stage diminishes.

For instance if one sets a maximum of 20 bar per stage and if one wishes to obtain a final pressure of 50 bar absolute, starting for instance from air at atmospheric pressure, one will have a first stage compressing from 1 to 10 bar absolute, then a second compressing from 10 to 30 bar, then a third from 30 to 50 bar. The compression ratios will be respectively 10:1, 3:1, and 1,66:1. The latter ratio is very small and means that, some degrees of rotation after a thread of the screw is sealed off, this thread must communicate with discharge; the consequence in such a compressor is that those areas of the casing where the injection orifices are usually placed in a low pressure compressor with compression ratios exceeding 2 or 3 are now practically exposed permanently to the discharge pressure and that it is necessary either to move towards intake the injection orifice—but then the leakage areas between screw and pinion are no more or only poorly fed with sealing liquid—or to inject liquid through a pump—but drive a pump when the pressure of the liquid to be moved exceeds 30 bar begins posing problems of sealing the drive shaft of the pump, and above 200 bar even becomes practically insoluble.

The object of the invention is to provide a high pressure compression device allowing high pressure injection in the compressor while avoiding the above cited drawbacks.

According to the invention, there is provided a device for high pressure compression, comprising a compressor, driven by a motor means and discharging via a high pressure conduit into a high pressure reservoir, said reservoir being connected on the one hand to an enhaust conduit for the compressed gas, and on the other hand to at least one conduit for an injection liquid connected to at least one injection orifice made through a casing of the compressor, in an area of said casing substantially subjected to high pressure, wherein a pump is disposed on said injection liquid conduit, and is driven by a hydraulic motor mounted on the same shaft as the pump and driven by at least part of the fluid discharged by the compressor.

In a first embodiment, the entirety of the mixture of discharged liquid and gas is passed through the hydraulic motor; in a second embodiment, at least two injection conduits are provided, i.e. that already mentioned, connected to an injection orifice made in the casing in an area substantially subjected to high pressure, and another one provided with the motor and connected to an injection orifice made in the casing in an area substantially subjected to intake pressure.

In both cases, the pressure differential between the hydraulic motor and the pump remains limited, of the order of some bar, even if the absolute pressure within the pump as well as within the motor may reach very high values; this eliminates the need for an absolutely tight seal between motor and pump, small leaks from one to the other being acceptable without impairing the operation, and on the other hand the seal is only subjected to small pressure differentials. Thus, usual seals such as lip seals, labyrinths seals, and the like may be used.

Another advantage, especially in the case of the motor driven by the mixture of compressed gas and liquid, is that the efficiency is appreciably improved if compared to injection made at low pressure: indeed, the power spent to raise the pressure of the injected liquid from low pressure to high pressure is no more totally negligible when the flow of liquid has to reach, volumewise, several percent of the volume swept by the compressor in order to ensure a good sealing. Conversely, the power absorbed to move a pump providing some bar of pressure difference above high pressure remains negligible and below values of the order of one percent of the shaft power of the compressor.

Another advantage is to permit injecting at high pressure quantities of liquid that may be considerable without risking modifying the compression ratio, or at the limit, without risking to compress liquid—incompressible by nature—with all corresponding mechanical consequences. Indeed, the high pressure injection occurs when the thread already registers with the high pressure port and the liquid can escape without problem towards the exhaust of the compressor; if on the contrary it were injected during intake or beginning of compression, this would by the same amount reduce the volume available for the gas during compression and could at the limit result in a zero volume, thus in an accident. It is thus possible to multiply the number of injection orifices and to "drown" the high pressure leaks, especially between the screw and the pinion, under a repeated flow of liquid.

By providing in particular at least two injection orifices, one for the low pressure, one for the high pressure, one makes sure to have liquid in permanence, at beginning of compression through the low pressure injection orifice, and then afterwards through the high pressure orifice or orifices.

This invention shall be better understood when reading the description given hereinafter as a non-limiting example and the attached drawings in which.

Figure 1:
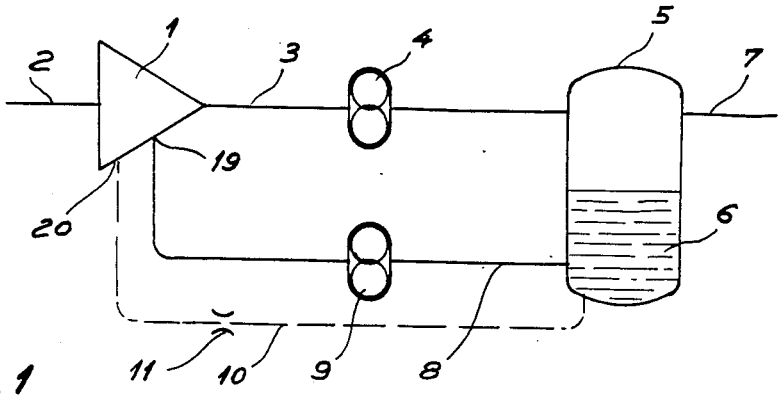
FIG. 1 is a schematic view of a first embodiment of the invention.

FIG. 1 shows a screw compressor 1 driven by a motor (not shown) and intaking through a conduit 2 gas at a high pressure of the order of at least 10 to 20 bar.

The compressor discharges via a conduit 3 that passes through a hydraulic motor 4. The inlet of motor 4 is connected to the outlet of compressor 1, and the outlet of motor 4 is connected by conduit 3 to a high pressure reservoir 5 filled in part with liquid 6. The compressed gas, separated from the liquid in the reservoir 5, exits towards the user device via a conduit 7 connected to the upper part of reservoir 5.

The liquid under pressure 6 is re-injected into the compressor at the high pressure (as shown hereinafter when referring to FIGS. 4 to 6) via a conduit 8. A pump 9 driven by motor 4 is mounted on conduit 8. The inlet of pump 9 is connected by conduit 8 to the bottom of reservoir 5, and the outlet of the pump 9 is connected by conduit 8 to the injection hole 19 made in a casing of the compressor 1 in an area substantially subjected to the exhaust pressure of the compressor.

There is eventually provided in parallel to the above cited high pressure injection device a low pressure injection device fed by a conduit 10, with a pressure drop 11 to limit the flow and terminating at the injection hole 20. At its end away from compressor 1, conduit 10 is connected to the bottom of reservoir 5.

Figure 2:
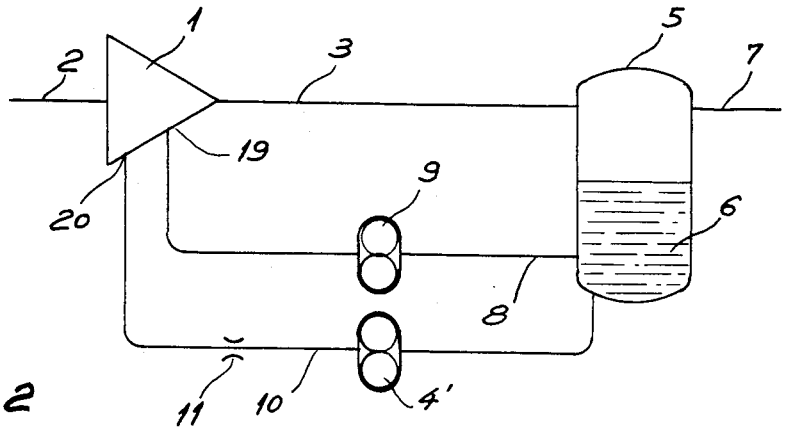
FIG. 2 is a schematic view of a second embodiment of the invention.

FIG. 2 shows an alternative embodiment in which the motor is no more on the exhaust conduit of the compressor, but is the motor 4' mounted on the low pressure conduit 10 between reservoir 5 and pressure drop 11.

It should be noted that the pressure drop in the motor 4' (as well as in the motor 4) is small and of the same order of magnitude as the pressure supplied by the pump 9, i.e. usually values of the order of 2 to 4 bar. Such values are in general sufficient to ensure a correct sealing as they give sufficient speed to the liquid to arrive in the zone of screw-pinion leaks on each pinion tooth and spread on such tooth well before the tooth leaves the screw.

This result is obtained via the pressure drop 11, constitued for instance by a restriction or a number of restrictions of conduit 10 such that if for instance the pressure difference between intake and discharge is 20 bar, approximately 4 bar are used to drive the motor 4,4 bar are used at the injection hole to give the liquid the necessary speed and 12 bar are lost in the pressure drop 11.

There follows that the pressure difference between the zone of the pump 9 at the highest pressure and the zone at the lowest pressure in the motor 4' does not exceed values around 8 bar.

In the case of FIG. 1, the differential would even be smaller as the flow of the motor 4 is much higher than the one of the pump 9, usually from 5 to 20 times higher. The differential pressure across the motor is thus most often below 1 bar and the pressure differential between motor and pump usually below 5 bar.

Figure 3:
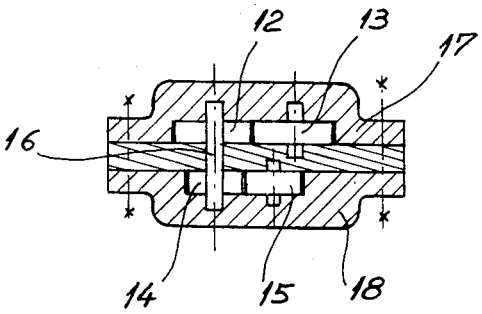
FIG. 3 is a sectional view of the assembly of a hydraulic motor and pump.

The small pressure differential, whether in the case of FIG. 1 or FIG. 2, permits a simple design of the motor-pump system as is seen on FIG. 3 where one has shown the two pinion gears 12 and 13 of the motor 4 and the two pinion gears 14 and 15 of the pump 9 and the common shaft 16 of the pinion gears 12 and 14 that provide the drive of the pump by the motor. The motor-pump assembly is mounted in a common casing made of two half-shells 17 and 18. Between these latter there is inserted a partition wall separating the motor 4 and 4' from the pump 9. Shaft 16 passes through the partition wall which is otherwise completely closed.

On account of the small pressure differential, one has not foreseen any seal around shaft 16 in the partition wall because small gas leak passing into the pump and the injection circuit have no effect on the efficiency.

It should be noted that the half-shells 17 and 18 forming the casing are designed to maintain inside the pump and motor absolute pressures that may be very high and exceed 100 bar (if for instance they apply to a fourth or fifth stage of compression) even though the pressure differential between motor and pump is small.

The pump and motor have been shown as gear devices but any equivalent device, especially volumetric device, such as a rotary vane, piston, etc . . . may be used within the scope of the invention.

Figure 4:
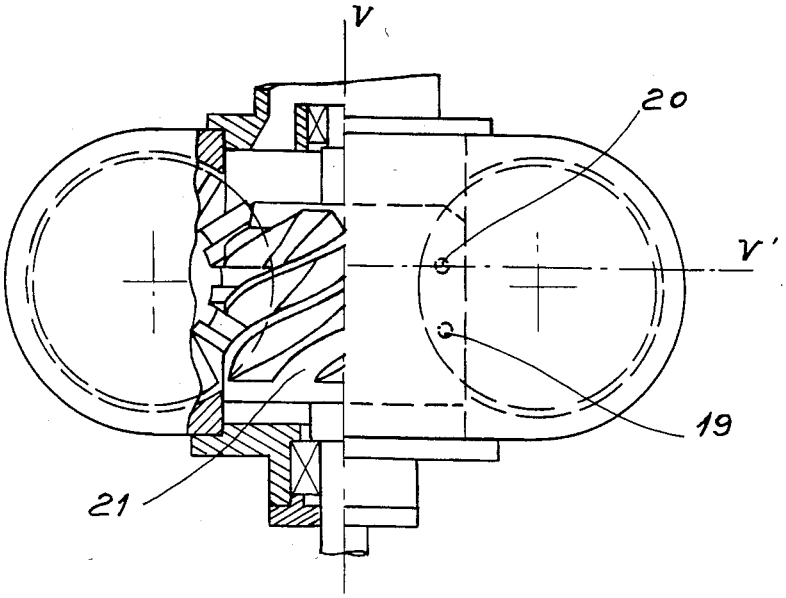
FIG. 4 is a sectional view, along the axis of the screw, of a screw compressor belonging to a device according to the invention.
Figure 5:
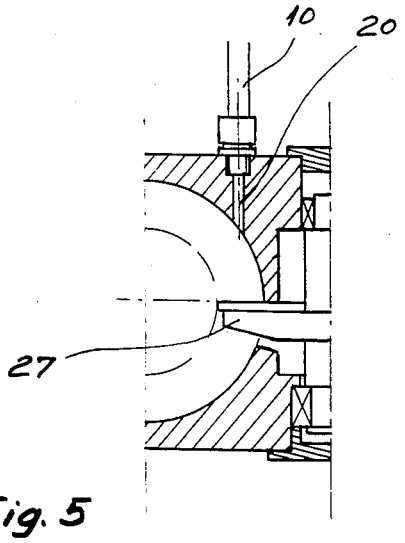
FIG. 5 is a sectional view along VV' of FIG. 4.
Figure 6:
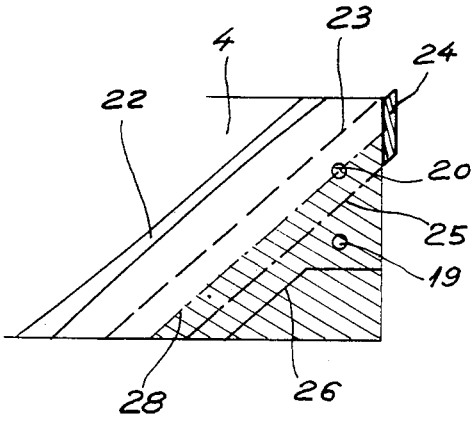
FIG. 6 is a stretched view of the screw of FIG. 4.

FIGS. 4, 5 and 6 show the ends of the conduits 8 and 10 and the corresponding injection holes 19 and 20.

FIG. 4 shows a compressor with screw and pinion of a known type, according to the French Pat. No. 1,331,998, in which the location where the injection orifices 19 and 20 penetrate through the casing are shown in dotted lines.

FIG. 5 shows as an example a section through the injection hole 20, whereas the section through hole 19—not shown—is absolutely similar.

FIG. 6 shows a stretched view of the screw 21 of FIG. 4 with a thread 22. The edge of the thread is in a position 23 when the groove is sealed by a pinion tooth 24, while the edge of the thread on the opposite side of the groove occupies a position 25 at this moment. The interval of the casing between these two lines 23 and 25 is thus alternately subjected to intake pressure and to the beginning of compression.

The outline of the discharge port has been shown in 26. It will be noted that this outline is rather near the edge position 25; as already indicated in the preamble, when intake pressure is high, a small compression ratio is necessary to obtain a pressure variation around 20 to 30 bar, which are the maximum differential pressures authorized by the strength or permissible flexure of components like the tooth supports 27 of the pinions shown in FIG. 5.

Due to small compression ratio, the exhaust pressure is obtained after a very limited rotation of the screw and the high pressure zone limited by line 28 (position of the edge of the thread that was in 23 at beginning of compression and that comes in said position 28 when the opposite edge of the groove comes to co-incide with the edge of the discharge port 26) and shown by hatching has a large extent.

An orifice located at beginning of compression such as 20 would be insufficient, not only because it is rather far from discharge but also, because of the extension of the high pressure zone and also because of the increase of the differential pressure with respect to conventional compressors in the 7 to 10 bar gauge, the "liquid seal", i.e. the small quantity of injected liquid that seals the leaks between screw and pinion would have completely disappeared into these leaks before the tooth had left the screw, thus leading to gas leaks the incidence of which on volumetric efficiency is much more important than the liquid leaks.

It is thus necessary to "repeat" that seal and thus necessary to operate at least one injection in the high pressure zone as explained above.

It shall be noted that it is obviously possible to multiply these injection orifices or to increase the number of pumps and circuits or to use the abovedescribed devices with compressors with cylindrical pinions according to the above cited French Patent or even with twin screw compressors without changing the nature of the invention.

I claim:

1. A device for high pressure compression of a fluid from a relatively low pressure to a relatively high pressure, comprising a compressor discharging said fluid, including a mixture of compressed gas and liquid, via a high pressure conduit into a high pressure reservoir, said reservoir being connected on the one hand to an exhaust conduit for the compressed gas, and on the other hand to at least one conduit for an injection liquid to provide a liquid seal in the compressor, said conduit being connected to at least one injection orifice located in a casing of the compressor in an area of said casing substantially subjected to said relatively high pressure, wherein a pump is mounted on said injection liquid conduit and is driven by a hydraulic motor mounted on the same shaft as the pump and driven by at least part of the fluid discharged by the compressor.

2. A device in accordance with claim 1, wherein said hydraulic motor is placed on the high pressure discharge conduit of the compressor and is driven by the discharged mixture of compressed gas and liquid.

3. A device in accordance with claim 1, moreover comprising a low pressure conduit connecting said high pressure reservoir with at least one injection orifice located in the casing of the compressor at a lower pressure than discharge pressure, and wherein said hydraulic motor is placed on said low pressure conduit and driven by the liquid fraction separated from the fluid discharged by the compressor.

4. A device in accordance with claim 3, wherein the hydraulic motor is mounted on the low pressure conduit between the reservoir and a pressure drop device.

5. A device in accordance with claim 1, wherein the hydraulic motor is of the volumetric type.

6. A device in accordance with claim 1, wherein the pump is of the volumetric type.

7. A device in accordance with claim 1, wherein the hydraulic motor and the pump are mounted in a common casing and mutually separated by a partition all passed through by the common shaft of the motor and of the pump.

8. A device in accordance with claim 1, wherein the compressor is a screw compressor.

* * * * *

UNITED STATES PATENT AND TRADEMARK OFFICE

CERTIFICATE OF CORRECTION

PATENT NO. : 4,569,640

DATED : February 11, 1986

INVENTOR(S) : BERNARD ZIMMERN

It is certified that error appears in the above-identified patent and that said Letters Patent is hereby corrected as shown below:

Column 1, line 62, "enhaust" should be --exhaust--;
Column 4, line 4, "and" should be --or--; and
Column 6, line 22, "all" should be --wall--.

Signed and Sealed this

*First* Day of *July 1986*

[SEAL]

*Attest:*

DONALD J. QUIGG

*Attesting Officer*

*Commissioner of Patents and Trademarks*